US008959868B2

(12) United States Patent
Robinson et al.

(10) Patent No.: US 8,959,868 B2
(45) Date of Patent: Feb. 24, 2015

(54) TRUSS SYSTEM

(71) Applicant: BlueScope Buildings North America, Inc., Kansas City, MO (US)

(72) Inventors: Clifford M. Robinson, Blue Springs, MO (US); David Douglas Archer, Lake Orion, MI (US)

(73) Assignee: BlueScope Buildings North America, Inc., Kansas City, MO (US)

( * ) Notice: Subject to any disclaimer, the term of this patent is extended or adjusted under 35 U.S.C. 154(b) by 0 days.

(21) Appl. No.: 13/836,034

(22) Filed: Mar. 15, 2013

(65) Prior Publication Data

US 2014/0075877 A1 Mar. 20, 2014

Related U.S. Application Data

(60) Provisional application No. 61/702,069, filed on Sep. 17, 2012.

(51) Int. Cl.
*E04C 3/02* (2006.01)
*E04C 3/08* (2006.01)
*E04C 3/04* (2006.01)

(52) U.S. Cl.
CPC ... *E04C 3/02* (2013.01); *E04C 3/08* (2013.01); *E04C 2003/0491* (2013.01)
USPC ..... 52/693; 52/690; 403/408.1

(58) Field of Classification Search
CPC ..... E04C 3/292; E04C 3/09; E04C 3/07; E04C 2003/0486; E04C 3/08; E04C 3/16; E04C 3/40; E04B 1/2612; E04B 1/19
USPC ..... 52/693, 408, 690, 696, 81.3; 403/408.1; 411/531, 545
See application file for complete search history.

(56) References Cited

U.S. PATENT DOCUMENTS 2,136,071 A * 11/1938 Braden ..... 52/694
3,122,224 A * 2/1964 Blickensderfer ..... 52/694
3,137,899 A * 6/1964 Troutner ..... 52/693
3,247,629 A * 4/1966 Behlen ..... 52/86

(Continued)

FOREIGN PATENT DOCUMENTS

WO 9222716 12/1992

OTHER PUBLICATIONS

International Search Report and Written Opinion issued in PCT Patent Application PCT/US2013/033131 dated Jun. 3, 2013, 10 pages.

*Primary Examiner* — Robert Canfield
*Assistant Examiner* — Babajide Demuren
(74) *Attorney, Agent, or Firm* — Lathrop & Gage LLP

(57) ABSTRACT

Disclosed is a truss, having an upper and lower chord member each extending in generally the same longitudinal direction and in spaced apart relation. The truss also includes a plurality of web members each with a first and second end, the web members including a crimped portion at the first and second end with openings disposed therein, wherein the first and second ends and openings of adjacent web members overlap. A lower chord fastening system extends through the lower chord and through the overlapping openings in the first ends of adjacent web members. An upper chord fastening system extends through the upper chord and through the overlapping openings in the second ends of two adjacent web members, wherein a plurality of lower and upper chord fastening systems are utilized across the entire length of the truss.

18 Claims, 10 Drawing Sheets

(56) References Cited

U.S. PATENT DOCUMENTS

| | | | | | |
|---|---|---|---|---|---|
| 3,330,087 | A | * | 7/1967 | Troutner | 52/693 |
| 3,422,591 | A | * | 1/1969 | Troutner | 52/693 |
| 3,496,693 | A | * | 2/1970 | Troutner | 52/693 |
| 3,537,224 | A | * | 11/1970 | Troutner | 52/693 |
| 3,570,204 | A | * | 3/1971 | Birkemeier | 52/289 |
| 3,591,995 | A | * | 7/1971 | Troutner | 52/693 |
| 3,656,267 | A | * | 4/1972 | Engle | 52/86 |
| 3,946,532 | A | | 3/1976 | Gilb | |
| 4,003,179 | A | * | 1/1977 | Gilb | 52/696 |
| 4,030,264 | A | * | 6/1977 | Jackson | 52/693 |
| 4,077,176 | A | | 3/1978 | Bauer | |
| 5,003,748 | A | * | 4/1991 | Carr | 52/693 |
| 5,013,391 | A | | 5/1991 | Hutter, III et al. | |
| 5,974,759 | A | * | 11/1999 | Burger | 52/695 |
| 6,758,022 | B1 | * | 7/2004 | Coll et al. | 52/690 |
| 6,799,406 | B2 | * | 10/2004 | Gosselin et al. | 52/694 |
| 7,213,805 | B2 | * | 5/2007 | Nishimura et al. | 269/228 |
| 7,530,548 | B2 | * | 5/2009 | Ochoa | 256/13.1 |
| 7,669,379 | B2 | | 3/2010 | Schierding | |
| 8,156,706 | B2 | | 4/2012 | Moody et al. | |
| 8,176,699 | B1 | | 5/2012 | Birchfield | |
| 8,387,330 | B2 | | 3/2013 | Wallner | |

* cited by examiner

TRUSS SYSTEM

RELATED APPLICATION

This application claims the benefit of priority to U.S. Provisional Application No. 61/702,069 filed Sep. 17, 2012.

FIELD OF THE INVENTION

This disclosure relates generally to the design and fabrication of trusses adapted for use in modular buildings and similar environments. More specifically, this disclosure concerns the simplification of the truss manufacturing process employing a fastening system for the truss chords and web members.

Trusses allow the construction of buildings without the utilization of interior columns or reduce the need for columns to spans that can approach 60 feet. For those seeking a building such as a warehouse or a big-box retail facility the use of trusses offer tremendous flexibility with maximizing floor space without interruption by columns.

Trusses can be constructed which have spaced apart chords and rigid interconnected web members. Such trusses are generally made for specific installations and are fabricated from components which are typically welded together and then the assembled truss is submerged in large tanks of primer and paint to fully cover the entire truss thereby protecting the truss and in particular, the welded joints against corrosion. Because trusses are critical structural members supporting considerable loads, their assembly at the weld points must satisfy demanding industry standards. Skilled welders with specialized certifications must be utilized to maintain the quality and the integrity of the welds in order to produce a product that meets and exceeds these industry standards.

Standard high strength steel is typically employed in the manufacture of the truss. As previously noted, once the welds are completed and the truss is fully assembled the entire truss is either submerged in a paint bath or painted utilizing a spray gun. Both operations require specialized equipment that increases the time and the cost of production of the trusses. Alternatively, galvanized steel elements could be used to fabricate a welded truss; however, the galvanizing must first be removed from the area to be welded. Once the galvanizing is removed and the truss elements are welded the weld point is unprotected against the corrosive effects of the environment. To protect the weld areas against corrosion the truss welds must be painted thereby defeating the purpose of using galvanized steel truss components.

For the foregoing reasons, there is a need for a truss assembly process that does not require painting of the entire truss prior to shipment.

For the foregoing reasons, there is a need for a truss assembly process that does not require specialized welding expertise to secure the web members to the upper and lower chords of the truss.

For the foregoing reasons, there is a need for a galvanized, pre-coated or pre-painted steel truss that when assembled does not require grinding of the weld area to remove surface protectants prior to assembly of the truss members.

For the foregoing reasons, there is a need for a truss that can be assembled using mechanical elements that provides a load capacity comparable to a similarly sized welded truss but at a lower overall cost.

SUMMARY

The present disclosure is directed to a truss, having an upper and lower chord member each extending in generally the same longitudinal direction and in spaced apart relation. The truss also includes a plurality of web members each with a first end a second end, the web members including a crimped portion at the first end and the second end with openings disposed therein, wherein the first and second ends and openings of adjacent web members overlap. A lower chord fastening system extends through the lower chord and through the overlapping openings in the first ends of adjacent web members. An upper chord fastening system extends through the upper chord and through the overlapping openings in the second ends of the two adjacent web members, wherein a plurality of lower and upper chord fastening systems are utilized across the entire length of the truss.

Various objects, features, aspects and advantages of the inventive subject matter will become more apparent from the following detailed description of preferred embodiments, along with the accompanying drawings in which like numerals represent like components.

DETAILED DESCRIPTION

The disclosed technology is directed to a structural roof truss that is mechanically assembled thereby avoiding the need for specialized welding expertise or the need to paint the truss when fully assembled. In one implementation, the truss includes upper and lower chords that are mechanically secured to the web members of the truss. The upper and lower chords incorporate equidistantly spaced punched holes for passing a fastener therethrough that in turn secures the upper and lower ends of the web members to the upper and lower chords. As a component of the fastening system a nut plate including a single set of flanges is employed at each fastening point to distribute the load applied by the nut and bolt over a greater area than just the back surface of the nut. The nut plate is positioned over a crimped segment in the web member and a nut is threaded to the bolt passing from the underside of the lower chord. Additionally, and generally only at mechanical fastening points proximate the two ends of the truss, where the loads at the connection points are the greatest, a washer or bearing plate is utilized to prevent slippage of the fastener and to prevent elongation of the hole punched in the chord.

Figure 1:
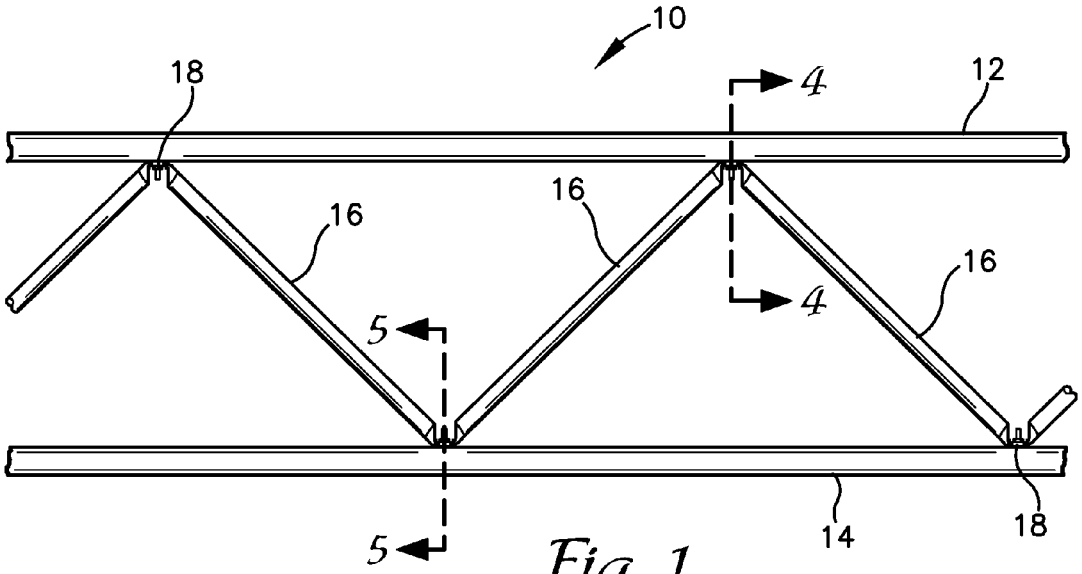
FIG. 1 is an elevation view of an embodiment of the truss assembled using mechanical fasteners.
Figure 3:
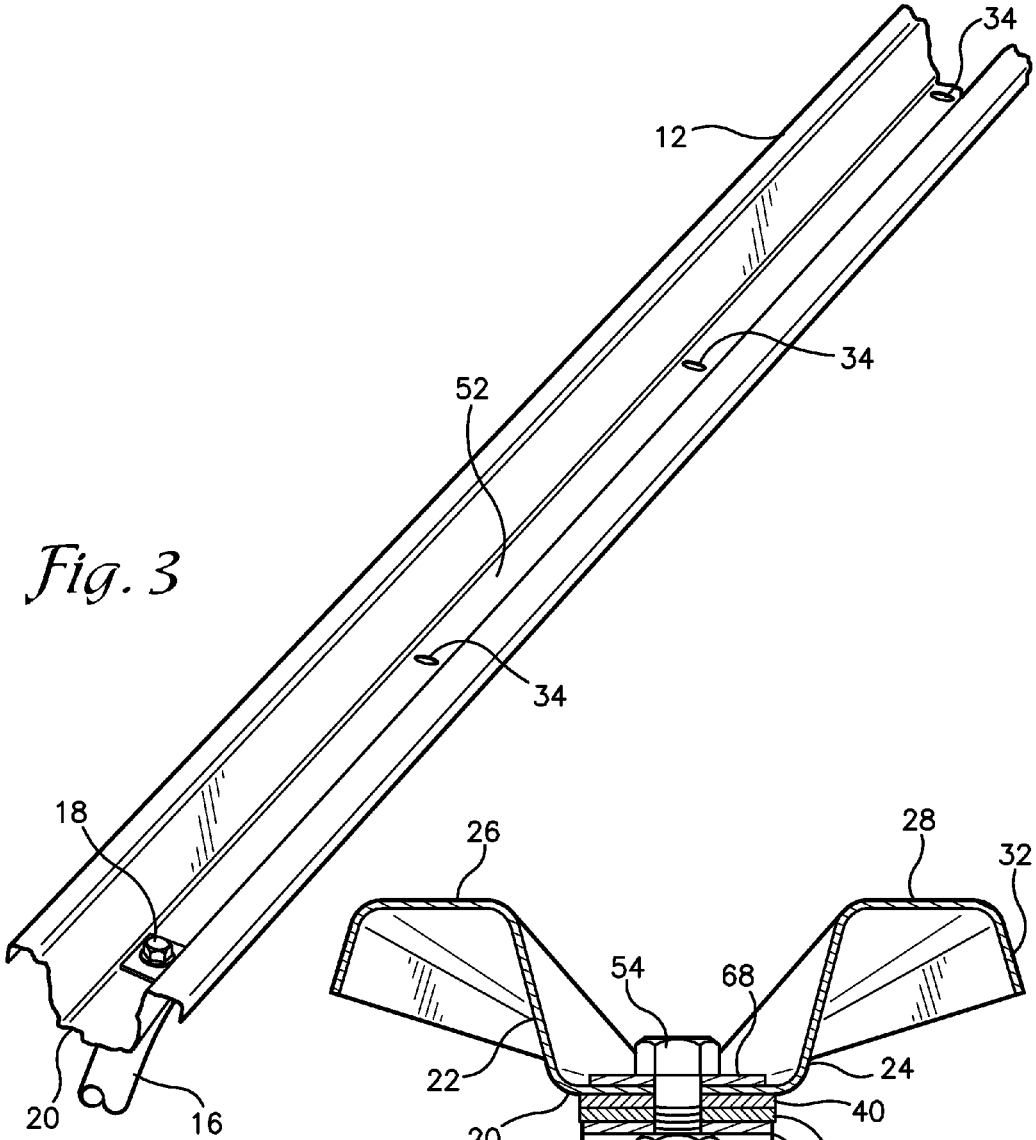
FIG. 3 is an perspective view of an embodiment of an upper chord for use in constructing the truss with mechanical fasteners.
Figure 4:
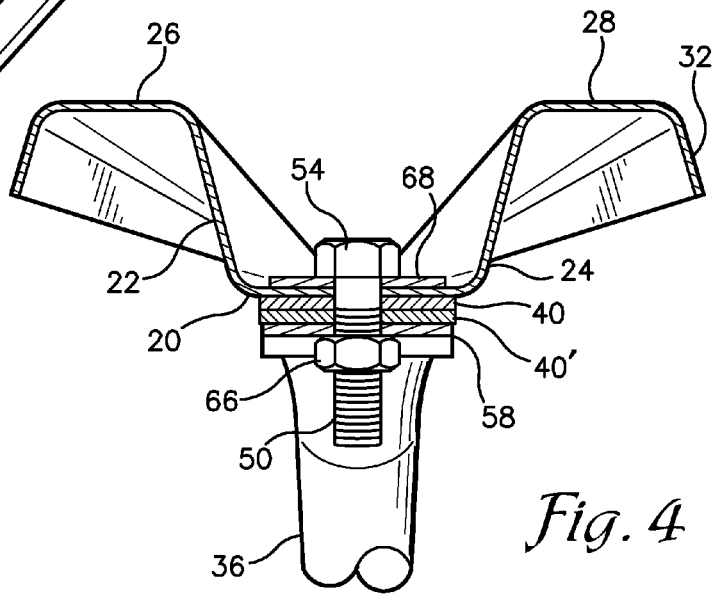
FIG. 4 is a cross sectional view along line 4-4 of FIG. 1 depicting an embodiment of mechanical fastening components securing a tubular member to an upper chord.

As shown in FIG. 1, the truss 10 disclosed herein is comprised of an upper chord 12 a lower chord 14, web members 16 and a mechanical fastening system 18. The upper and lower chords 12, 14 may be of a standard cross sectional design as shown in FIG. 4 with a main horizontal segment 20 two main vertical segments 22, 24, two secondary horizontal segments 26, 28 and two substantially secondary vertical segments 30, 32. As best seen in FIG. 3, the upper and lower chords 12, 14 include holes 34 pre-punched along the main horizontal segment 20 at predetermined distances preferably in the range of 50 to 80 inches. The separation distance of the pre-punched holes 34 varies depending upon the distance separating the upper and lower chords which typically ranges from 20 to 40 inches. The hole separation distance varies depending upon the maximum load that the truss is expected to carry, the anticipated distribution of the load along the truss, the span of the truss and other design aspects.

The pre-punched holes 34 are used to mechanically secure the web members 16 to the upper and lower chords 12, 14. The holes are preferably in the range from 0.5 to 0.75 inches in diameter depending upon the load the truss is expected to carry and the size of the mechanical fastening hardware that is required to accommodate the design loads.

The present invention can eliminate the need for painting of the trusses following fabrication. Once trusses are fabricated they may for a period of time, either during shipment or possibly post-delivery while awaiting installation in the structure, be exposed to the elements including precipitation prior to installation. Exposure to high moisture environments can lead to oxidation of the steel trusses unless they are fabricated from galvanized steel or coated with a paint or primer prior to transit. The various elements, including the chord and web members, are preferably galvanized or pre-coated to satisfy the aesthetic requirements of the customer and then assembled into the finished product. Utilizing the pre-coated or galvanized chords and web members as well as the fastening system disclosed herein, oxidation of the surface of the steel members is substantially eliminated.

Figure 2:
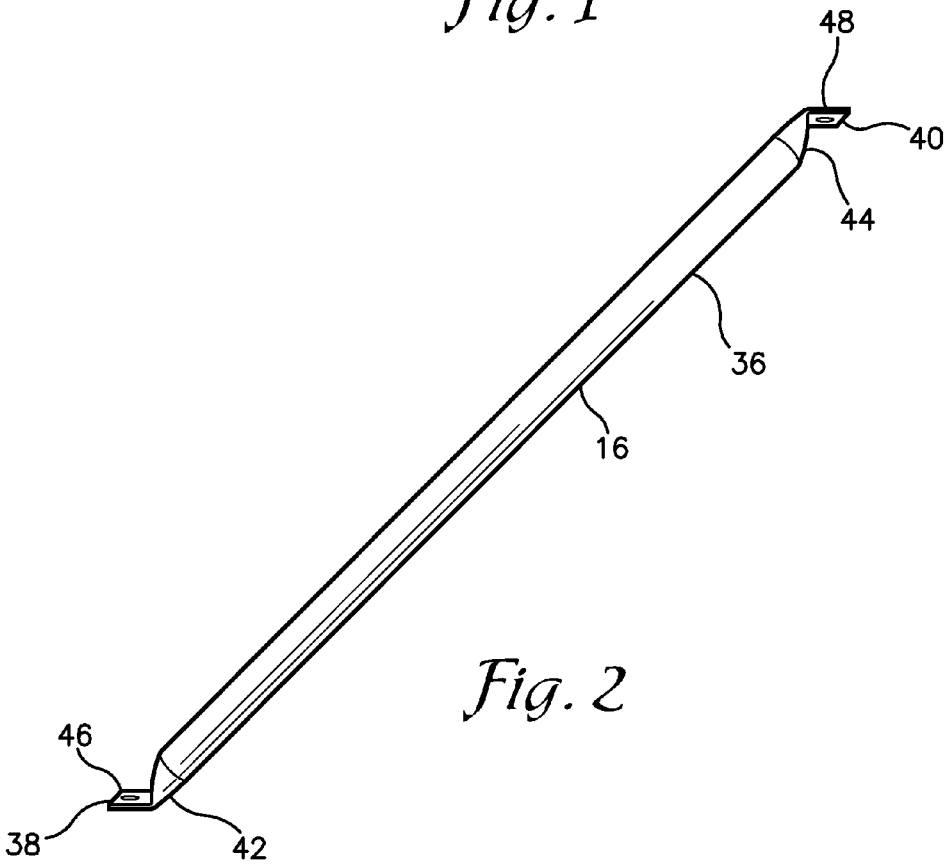
FIG. 2 is a perspective view of an embodiment of a tubular web member.

A first implementation of a web member 16 disclosed herein, and as seen in FIG. 2, is preferably a linear element. The web member 16 is preferably comprised of a tubular member 36 with a diameter in the range of 1 to 2 inches and a length of from 20 to 50 inches; however, the use of the term "tubular" should be not be construed to limit the web members 16 to a circular cross section. The term "tubular" should be construed expansively to include oval, square, rectangular and other cross sectional shapes. The wall thickness of the tubular member 36 and the length of the tubular member 36 vary depending upon the design and load calculations of a particular truss.

As seen in FIG. 2, both ends of the tubular member 36 are crimped by a press creating two flat spans 38, 40. These flat spans 38, 40 are bent at an angle of approximately 45 degrees from the tubular member 36 and run effectively parallel with one another but are facing in opposite directions. The flat spans are preferably about 2.0 inches in length and 2.0 inches in width; however, these dimensions may vary depending upon the design and the load calculations for the specific truss undergoing fabrication. As a consequence of the press operation that forms the flat spans 38, 40 the tubular member adjacent each flat span is deformed from a tubular configuration to a collapsed tubular configuration. These collapsed portions 42, 44 play a role in the mechanical fastening system 18 that is discussed in greater detail below.

As also seen in FIG. 2, punched into the center of each flat span 38, 40 are holes 46, 48 that are used for connecting the tubular members 36 to the upper and lower chords 12, 14 with a mechanical fastener. The punched holes are preferably in the range of from 0.5 to 0.75 inches in diameter; however, these dimensions may vary depending upon the design and load calculations for the particular truss.

Figure 6:
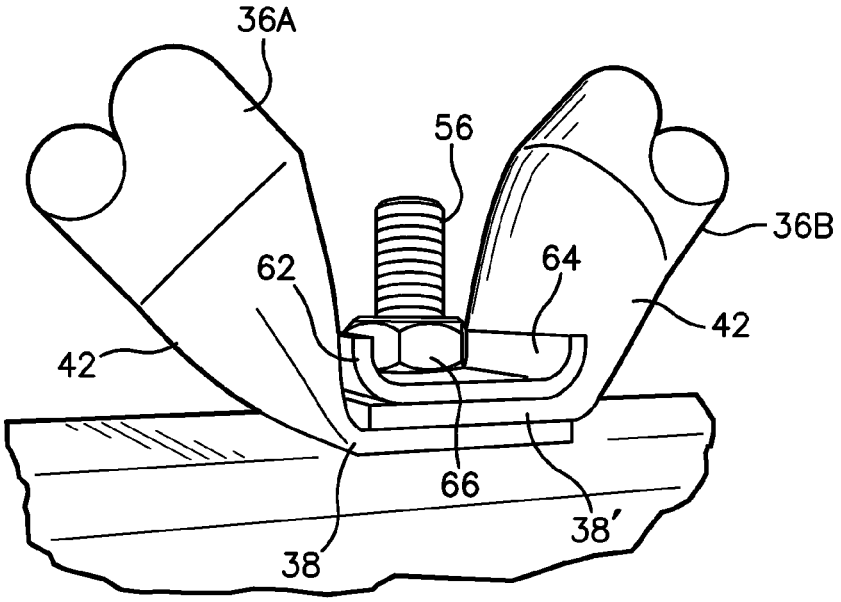
FIG. 6 is a perspective view of an embodiment of the truss mechanical system fastening components securing two tubular members to the lower chord.
Figure 7:
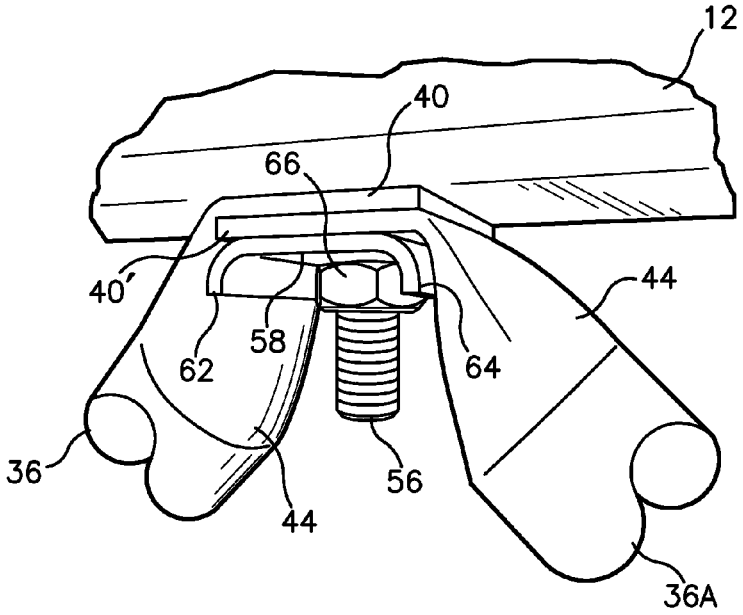
FIG. 7 is a perspective view of an embodiment of the truss mechanical system fastening components securing two tubular members to the upper chord.

Fabrication of a truss 10 according to one implementation begins with separating the upper and lower chords 12, 14 by a distance sufficient to allow the placement of the tubular members 36 between them. As is shown in FIG. 7, the upper flat span 40 of a first tubular member 36 overlaps the upper flat span 40' of the adjacent tubular member 36A when secured to the upper chord 12. Conversely, and as seen in FIG. 6, the lower flat span 38 of the tubular member 36A is overlapped by the lower flat span 38' of the third tubular member 36B. This successive staggering of the flat spans 38, 40 of the adjacent tubular members 36 allows only a single length of tubular member 36 along the entire span.

Figure 8:
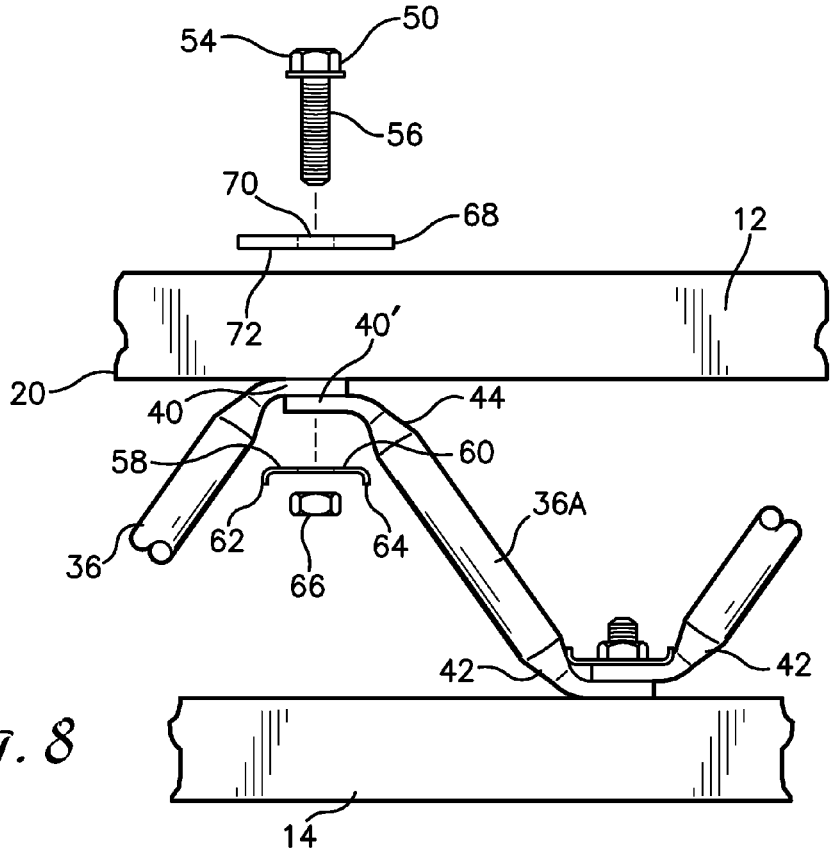
FIG. 8 is an exploded view of an embodiment of the truss system showing the mechanical fastening components of the truss at an upper chord.

In order to secure the tubular members 36 to the upper chord 12 a bolt 50, as seen in FIG. 8, is passed through the hole 34 in the main horizontal segment 20 of the upper chord 12 until the head 54 of the bolt 50 contacts the upper surface 52 of the main horizontal segment 20. The threaded portion 56 of the bolt 50 passes through the holes 48 in the overlapping upper flat spans 40, 40' of the adjacent tubular members 36. Positioned beneath the overlapping upper flat spans 40, 40' is a nut plate 58 that is comprised of a flat plate 60 with two opposed curved flanges 62, 64. The nut plate flanges 62, 64 are curved in a manner that is consistent with the angularity of the lower conical portion 44 of the tubular member 36 as seen in FIG. 6. The nut plate 58, like the chords 12, 14 and tubular members 36, is preferably fabricated from high strength steel capable of withstanding substantial loads while experiencing little localized deformation.

The nut plate 58 is also preferably about 2.0 inches in length and about 2.0 inches in width with a thickness preferably in the range of 0.1 to 0.2 inches. The nut plate 58 serves as a bearing surface for the back face of the nut 66 that is threaded onto the bolt 50. In one embodiment, the nut 66 is separate from the nut plate 58 and is torqued into position to secure the upper flat spans 40 of the adjacent tubular members 36, 36A to the upper chord 12. In an alternative embodiment, the nut 66 is rigidly secured to the nut plate 58 and is tightened into position by rotating the head 54 of the bolt 50. As seen in FIG. 7, when installed beneath the overlapping upper flat spans 40 the nut plate flanges 62, 64 extend downwardly in nominal alignment with the lower conical portions 44 of the tubular members 36, 36A. This alignment prevents the nut plate 58 from rotating more than a few degrees when torque is applied to the nut 66 or the head 54 of the bolt 50 as the upper conical portions 44 interfere with the flanges 62, 64 should the flanges begin to rotate. In a variation of the assembly process described immediately above for securing the tubular members 36 to the upper chord, the bolt 50 may also extend upwardly, instead of extending downwardly, through the flat spans 40, 40' and the upper chord 12 without impacting the functionality or load carrying capacity of the truss 10. Once the threaded portion 56 of the bolt 50 passes through the upper chord a nut 66 is threaded to the bolt 50 and tightened into position. Either orientation of the bolt whether facing up or down may require that the head of the bolt 54 as well as the nut 66 be retained by a tool, such as a socket mounted upon a ratchet, to tighten the fastening system 18 to the desired tightness.

Figure 5:
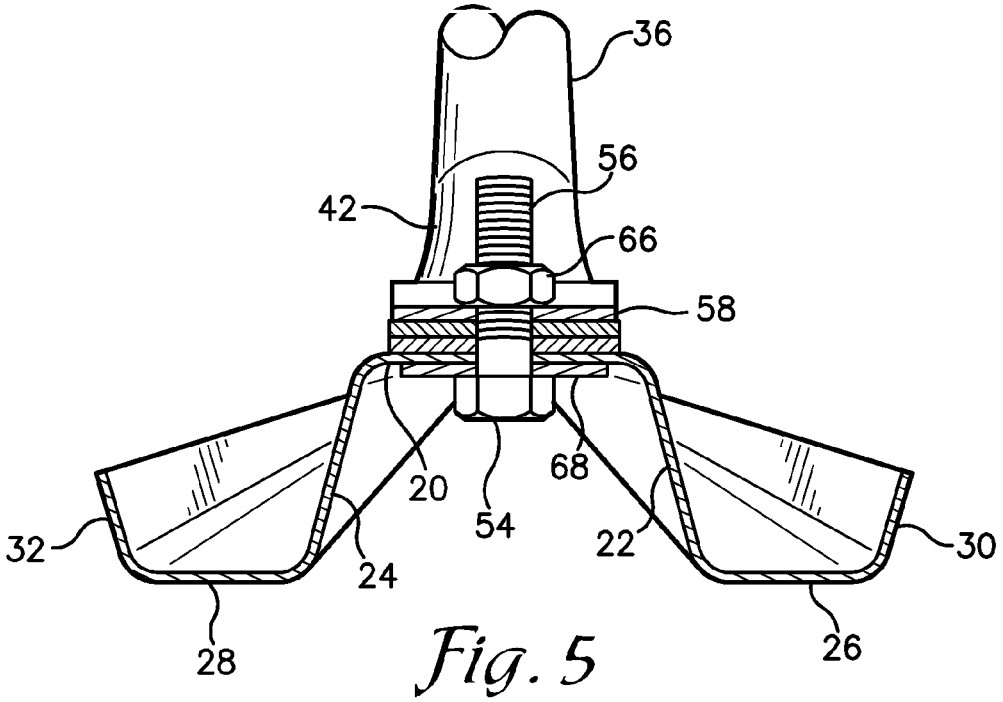
FIG. 5 is a cross sectional view along line 5-5 of FIG. 1 showing an embodiment of mechanical fastening components securing a tubular member to a lower chord.

As previously mentioned, at times the design of a particular truss and the load that the truss is intended to bear require the installation of a washer 68, as seen in FIG. 8, at one or more chord mechanical fastening locations proximate the ends of each truss. These washers 68 may be employed on both the upper and/or lower chords 12, 14. The washer 68 is preferably fabricated from high strength steel and is intended to distribute the load applied by the bolt head 54 across a greater area than just the contact surface of the bolt head 54. The washer 68 further includes an opening 70 through which the bolt 50 passes when securing the tubular members 36 to the chords 12, 14. In order to prevent, or at least limit, movement of the washer 68 under the high stress loads experienced at the ends of the truss, one side of the washer 68 is preferably roughened to minimize the prospect of slippage of the washer along the main horizontal segment of the upper and lower chords 20. FIGS. 4, 5 and 8 reveal the presence of a washer 68 in the assembly of the mechanical fastening system of the truss embodiment. Whether a washer 68 is actually included in the assembly of the mechanical fastening systems 18 near the ends of the truss 10 depends upon design criteria and load calculations.

The roughened surface 72 may be fabricated by forming or cutting serrations into the surface, knurling the surface of the washer 68, or by applying a granular texture to the surface of the washer 68 with an adhesive or alternately by applying a coating through spraying or dipping the washer. The roughened surface 72 prevents, or at least minimizes, movement of the washer 68 and the bolt 50 passing through the hole 34 punched into the lower chord 14. Once the mechanical fastening system 18 is secured in position, eliminating or reducing movement of the washer 68 and the bolt 50 reduces the potential for elongation of the punched holes 34 in the chords 12, 14. The specific number of attachment points where the washer 68 is employed is established once the truss design and load calculations are fully evaluated.

The methodology described immediately above is repeated across the entire upper chord 14 with adjacent tubular member 36 flat spans 40 overlapping one another in a consistent manner from one mechanical fastening point to the next. As seen in FIGS. 5-6, the same process is repeated along the entire lower chord 14 wherein a lower tubular member flat span 38' is positioned atop an adjacent tubular member flat span 38. This implementation requires that the two flat spans 38, 40 of a single tubular member 36 do not reside in both upper positions or both lower positions at the same time but must alternate among connection points. Because the tubular members 36 are fabricated in a single specified length for each truss 10 span there must be uniformity in placement of these tubular members across the entire span. Placing the flat spans 38, 40 of the tubular members 36 in the overlap position at the upper chord 12 and in the underlap position on the lower chord 14 would require an elongation of the tubular member 36 in order for the holes 46, 48 in the flat span 38, 40 to align with the holes 34 in both chords 12, 14. Likewise placing the flat spans 38, 40 of the tubular member in the underlap position at the upper chord 12 and the overlap position at the lower chord 14 would require a shortening of the tubular member 36. Neither elongation nor shortening of the tubular members is desired since utilizing a specified length of tubular member 36 along the span reduces span costs as compared to using multiple lengths of tubular members. Moreover, a single length of tubular member simplifies the truss fabrication process.

The overlap pattern of the flat spans 38, 40 must remain consistent along the entire length of the truss. As discussed above for the upper chord 12 when assembling the lower chord the bolt 50 may be advanced through the lower chord 14 either from above or below the chord such that the nut 66 resides either above the chord as seen in FIG. 6, or below the chord (not shown). Whether the nut 66 resides above or below the chord will not impact the functionality or load carrying capacity of the truss 10. Once the threaded portion 56 of the bolt 50 passes through the lower chord 14 a nut 66 is threaded to the bolt 50 and tightened into position. Either orientation of the bolt whether facing up or down may require that the head of the bolt 54 as well as the nut 66 be retained by a tool, such as a socket mounted upon a ratchet, to tighten the fastening system 18 to the desired tightness.

Figure 9:
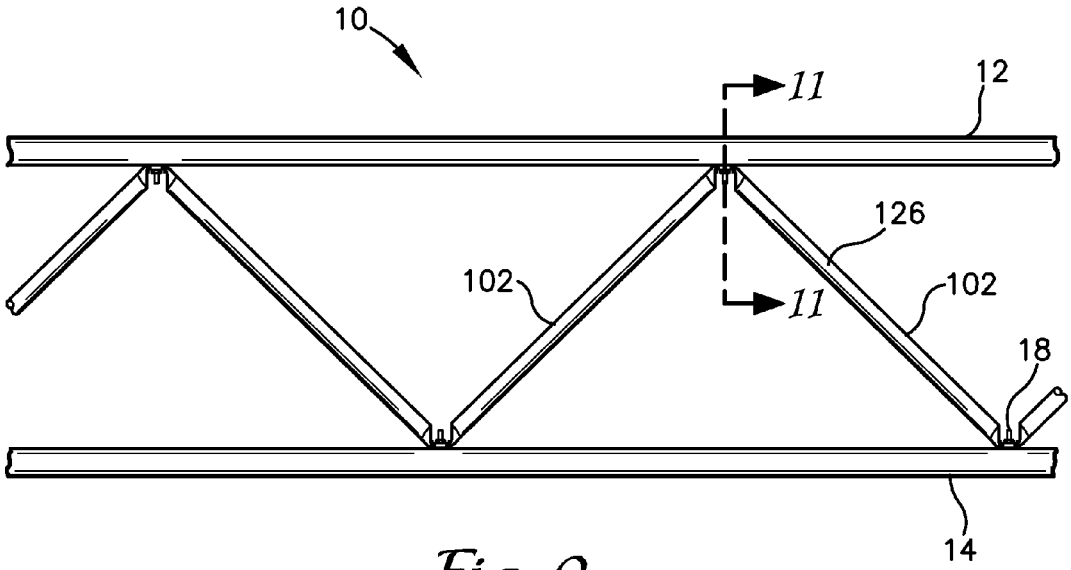
FIG. 9 is an elevation view of an embodiment of the truss assembly using mechanical fasteners.
Figure 10:
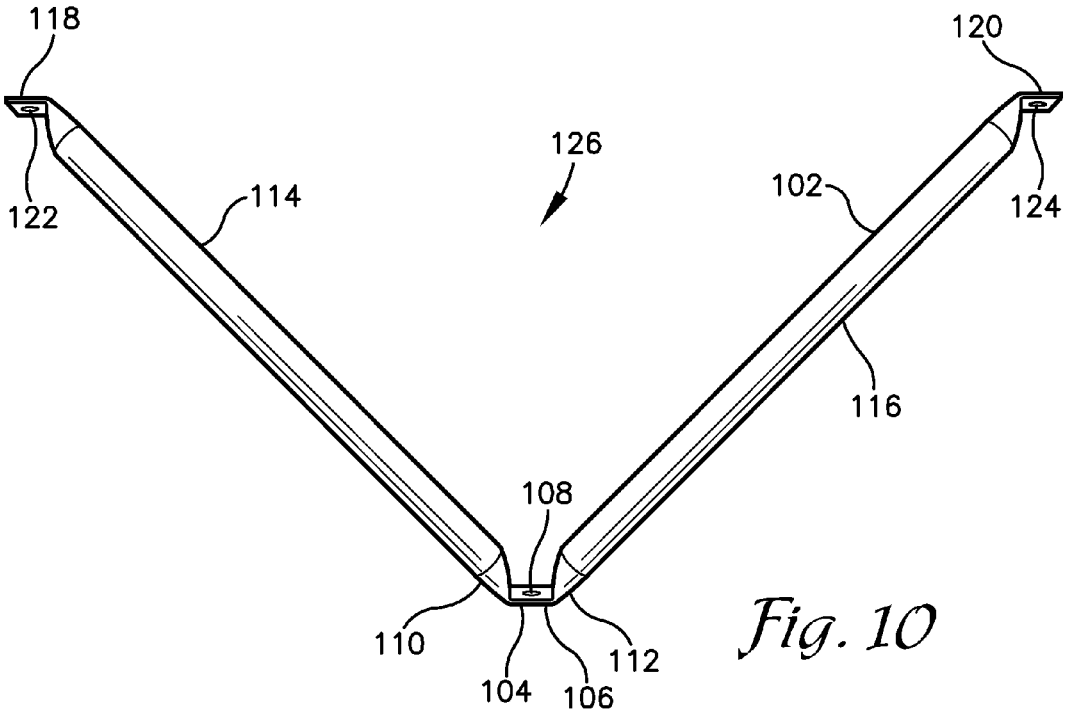
FIG. 10 is a perspective view of an embodiment of a V-shaped tubular web member.
Figure 12:
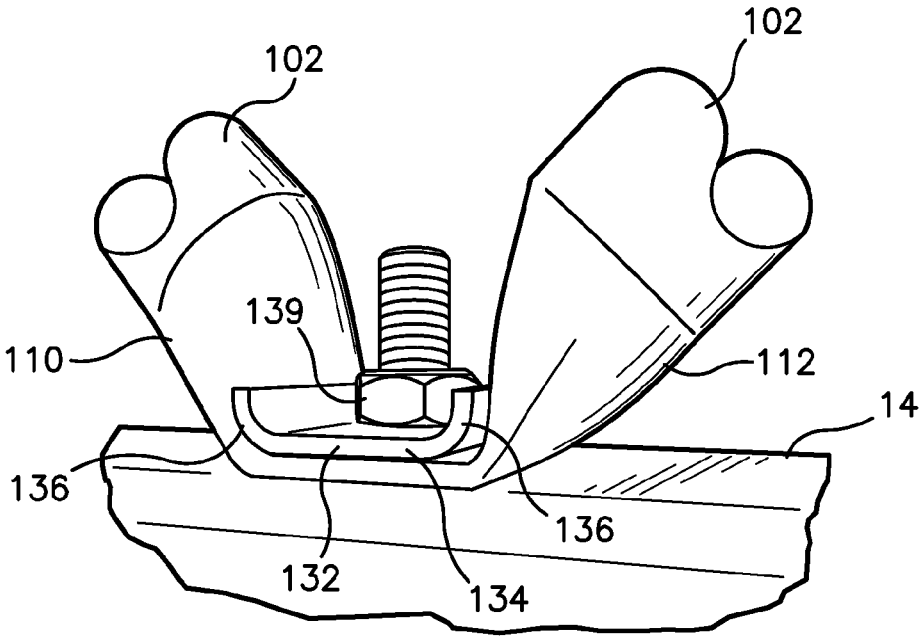
FIG. 12 is a perspective view of an embodiment of the truss system showing the mechanical fastening system components of the truss at the lower chord.

An alternative embodiment of the truss 10 design, as shown in FIG. 9, also employs a tubular member 102 that, as discussed above, may have a wide variety of cross sectional shapes. As seen in FIG. 10, the tubular member 102 may be hollow with walls of a specified diameter. The tubular member 102 is mechanically compressed at the mid-point 104 forming a flat span 106 and creating two separate arms 114, 116. The flat span 106 is preferably about 2 inches in width and about 2.0 inches in length but alternative dimensions may also be employed as the load conditions of the truss dictate. A hole 108, as seen in FIG. 10, is punched into the center of the flat span 106 and the diameter of the hole is preferably in the range of from 0.5 to 0.75 inches. Adjacent the flat span 106, as seen in FIGS. 10 and 12, are two conical sections 110, 112 of the tubular member 102. The conical sections 110, 112 are formed from the compression of the tubular member 106. In addition to the mechanical compression forming the flat span 106, the two equivalent length arms 114, 116 of the tubular member are each bent upwardly at an angle of approximately 45 degrees from horizontal creating an angle of approximately 90 degrees separating the two arms 114, 116.

As shown in FIG. 10, as with the first embodiment, the end of each arm 114, 116 as with the mid-point 104, is compressed flat by a mechanical press. The approximately final 2 inches of each arm 114, 116 is pressed flat forming a flat section 118, 120 at the end of each arm. The flat sections 118, 120 are also formed at an angle of approximately 45 degrees to each tubular member. This angled orientation of the flat section 118, 120 allows the flat section to run parallel with the upper and lower chords 12, 14 when installed and facilitates attachment to the chords as is discussed in greater detail below. Each of the flat sections 118, 120 also includes a punched hole 122, 124 that is used to secure the V-shaped member 126 to the upper chord 12.

Figure 16:
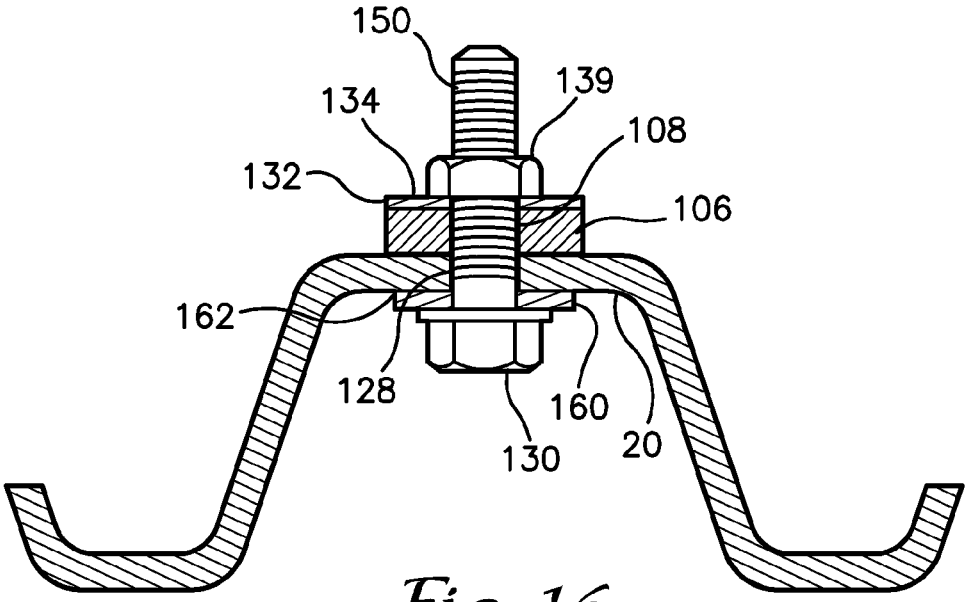
FIG. 16 is a cross sectional view along lines 16-16 of FIG. 14 showing an embodiment of the mechanical fastening system.

In fabricating the truss 10, the pre-punched hole 108 in the flat span 106 of the V-shaped web member 126 is placed over a pre-punched hole in the lower chord 14. As with the first embodiment, the location of the pre-punched holes 128 is determined in advance of the truss fabrication based upon the desired design and load calculations. As seen in FIG. 16, once the two holes, 108, 128 are aligned, a bolt 130 is preferably passed upwardly through the hole 128 in the lower chord 14 and then through the pre-punched hole 108 in the flat span 106. Alternatively, and as discussed above, the bolt 130 may be passed downwardly through the lower chord 14 instead of passing upwardly without compromising either the flexibility of assembly or the structural capacity of the truss. Positioned atop the flat span 106 is a nut plate 132 comprised of a flat plate 134 and, as seen in FIG. 12, extending outwardly from the flat plate 134 are a set of oppositely disposed flanges 136. The nut plate 132 also includes a pre-punched hole 138 in roughly the center of the nut plate 132. The nut plate 132, as discussed above, is preferably about 2.0 inches in length, about 2.0 inches in width and preferably between 0.10 and 0.20 inches in thickness. The nut plate 132 serves as a bearing surface and distributes the load applied by the bolt 130 and nut 139 across a greater area than just the back face of the nut 139 thereby preventing localized deformation of the flat span 106.

Trusses frequently experience their greatest loads at the far ends of the truss 10 and therefore the mechanical fastening system 18 at the ends of the truss experience the greatest stresses. Depending upon the calculated stress a particular mechanical connection point may require the use of a washer 160 positioned beneath the head of the bolt 130, such as shown in FIG. 16. One side of the washer 160 preferably utilizes a roughened surface 162 that is placed against the bottom surface of the main horizontal channel 20 of the lower chord 14. This roughened surface 162 prevents slippage between the washer 160 and the bottom surface of the horizontal channel 20 which in turn greatly reduces or eliminates the prospect of elongating the hole 128 in the lower chord 14. Not all connection points, such as those away from the ends of the truss necessarily require the insertion of a washer 160 into the mechanical connection system 18.

The bolt 130 continues upwardly passing through the hole 138 in the nut plate 132. After passing through the hole 138 a nut 139, as seen in FIGS. 12 and 16 is threaded to the bolt 130 and a specified amount of torque is applied to the nut 139 or the head of the bolt 130 to tighten the mechanical fastening system into position. The nut plate 132 may attempt to rotate while the nut 139 is tightened to the requisite torque level. However, as intended, the nut plate flanges 136 interfere with the conical sections 110, 112 and rotation of the nut plate 132 is prevented. Once the nut 140 is torqued to the desired level attachment of the first and second arms of the V-shaped web member 126 follows next in sequence.

Figure 11:
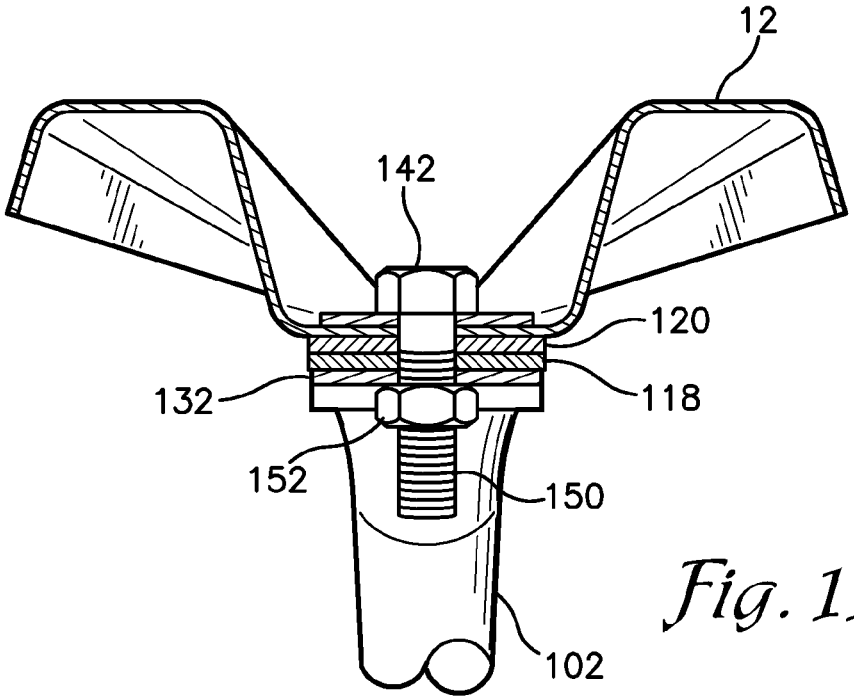
FIG. 11 is a cross sectional view along lines 11-11 of FIG. 9 showing an embodiment of mechanical fastening components securing a tubular member to an upper chord.
Figure 13:
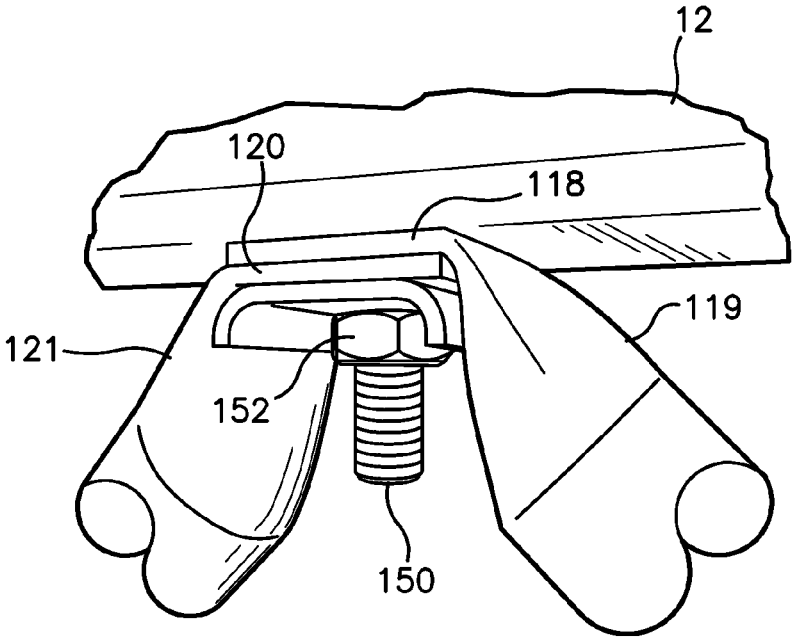
FIG. 13 is a perspective view of an embodiment of the truss system showing the mechanical fastening system components of the truss at the upper chord.
Figure 15:
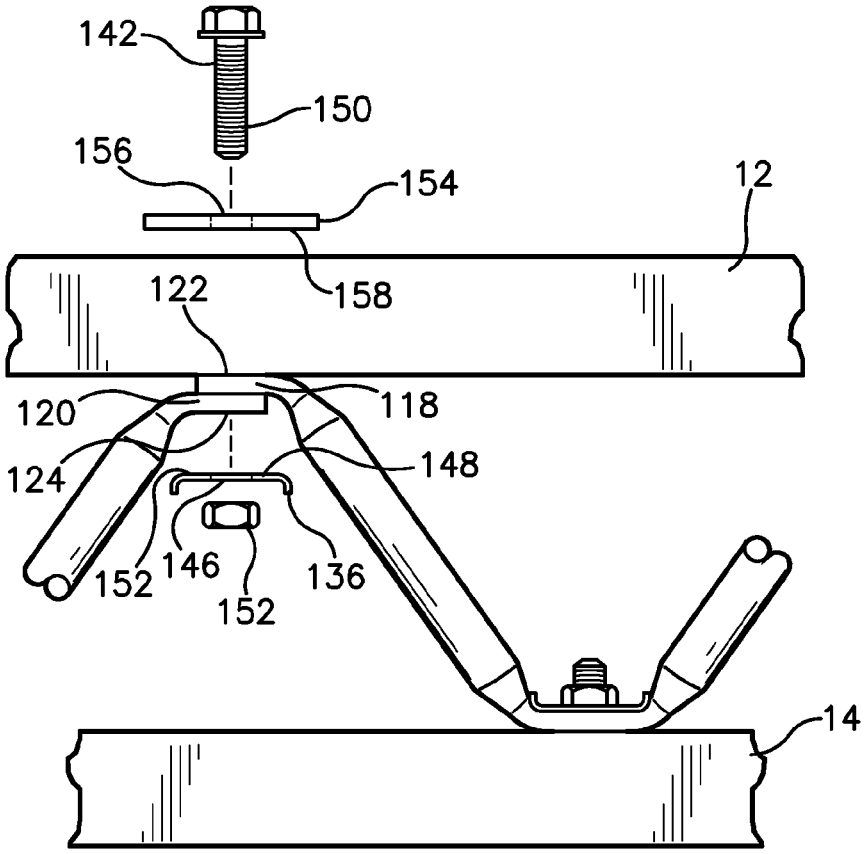
FIG. 15 is an exploded elevational view of an embodiment of the truss system mechanical connection at the upper chord.
Figure 17:
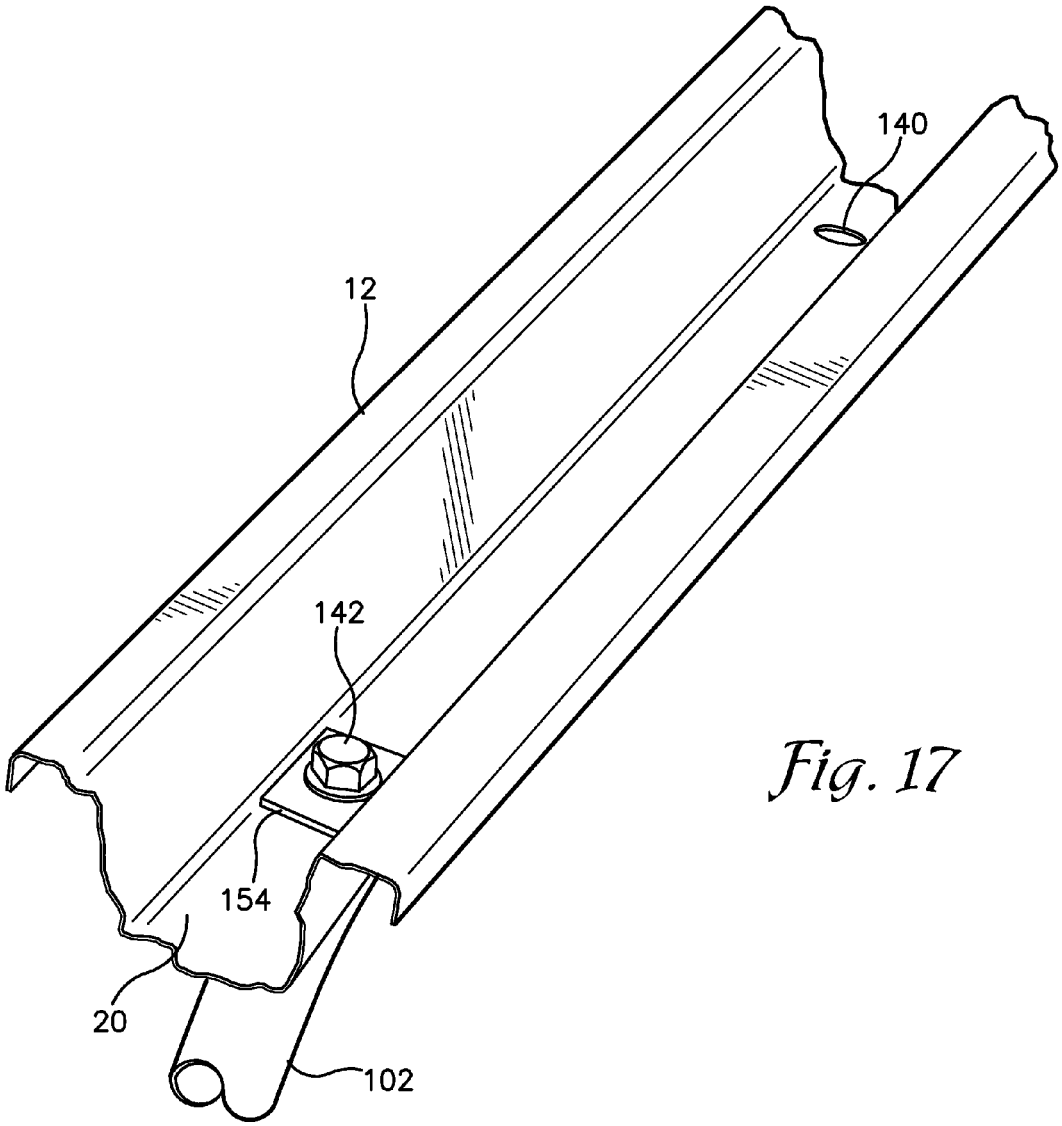
FIG. 17 is a perspective view of an embodiment of an upper chord of the truss system.

The punched hole 122 in the crimped end of the first arm 118, as seen in FIG. 10, is aligned with a punched hole 140 in the upper chord 12 as best understood by viewing FIGS. 15, 16 and 17. The punched hole 124 in the crimped end 120 of a second arm 116 of a V-shaped web member 126 align with an adjacent hole 140 in the upper chord. As seen in FIGS. 11 and 15, once there is vertical alignment of the various holes 122, 124, 140 a bolt 142 is passed downwardly through the referenced holes and then through a hole 146 in a nut plate 148 that is disposed beneath the overlapping crimped end 118 of the first arm 114 of the instant V-shaped member and the crimped end 120 of a second arm 116 of an adjacent V-shaped member 126. As discussed above, the bolt 142 may alternately be passed upwardly through the referenced holes without impacting the flexibility of assembly or the structural capacity of the truss 10. The nut plate 148 has identical characteristics to those discussed above for the attachment of the web member to the lower chord 114. Once the threaded portion 150 of the bolt 142 emerges from the nut plate hole 146 a nut 152 is secured to the bolt 142 and tightened to the specified level or rotated to a desired orientation. As discussed with the attachment to the lower chord 14, the flanges 136 of the nut plate 132 when rotated interfere with the conical sections 119, 121 of the crimped ends 118, 120 of the overlapping first and second arms 114, 116. When fully assembled the mechanical fastening 18 at the upper chord 12 appears as seen in FIG. 13.

Figure 14:
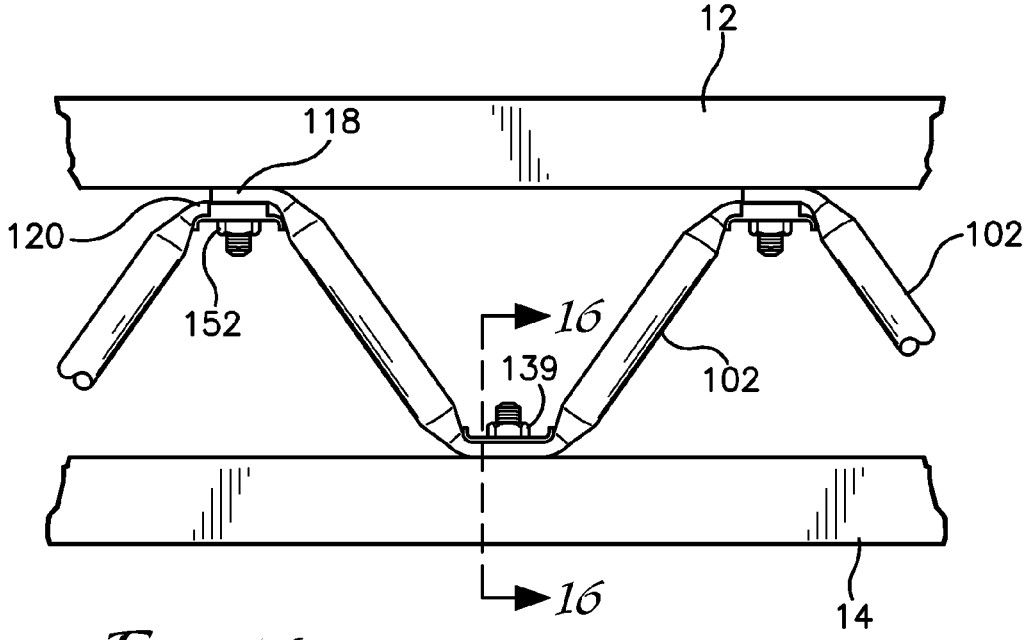
FIG. 14 is an elevation view of an embodiment of the truss system showing the mechanical fastening system of the truss.

The attachment process for each arm 114, 116, as described above, is repeated across the entire truss 10 maintaining the consistency of the crimped section 118, 120 overlap across the entire truss. When the truss using the V-shaped web member 126 is assembled it appears as seen in FIG. 14. As discussed above with the lower chord attachment process, for those trusses that are designed to handle increased structural loads near the end of each truss a component for limiting deformation of the holes 140 in the upper chord is a washer 154 similar to that described above at reference number 68. Whether a washer 154 is employed at the ends of the truss 10 depends upon the design and the load calculations for each particular truss. The washer 154 includes a hole (not shown) through which passes the bolt 142 and a side that is serrated, knurled or includes a roughened surface (not shown). As discussed above, and as seen in FIG. 17, the washer 154 is placed between the head of the bolt 142 and the main horizontal segment 20 of the upper chord 12 with the purpose of spreading the load applied by the bolt 142 and the nut 152 and preventing slippage of the bolt that could cause elongation of the hole 140 punched in the upper chord 12.

Figure 18:
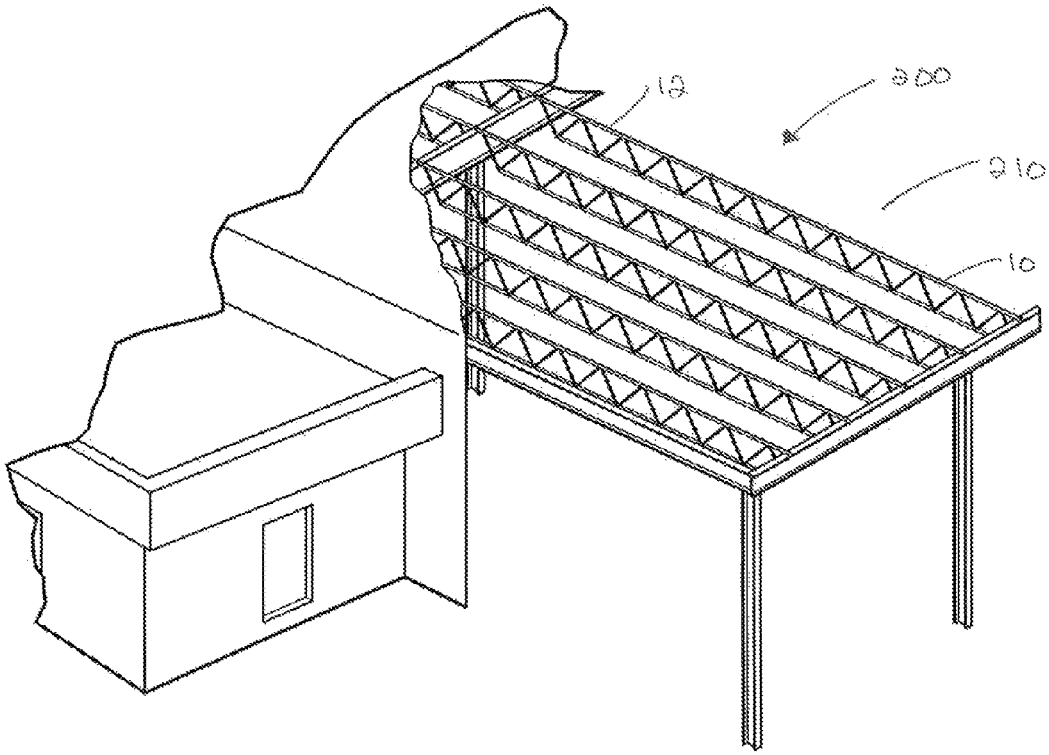
FIG. 18 is a perspective view of a fully assembled truss system in position atop an erected structure.

The truss system 200 as seen in FIG. 18 is used to support the roof of a building 210. The truss 10 spans and extends over the interior of the building and eliminates or greatly reduces the need for support columns thereby freeing the interior space of obstructions. The implementation of the truss system typically involves placement of the upper chord 12 atop an end seat (not shown) which is in-turn atop a primary frame. Trusses 10 are typically separated from an adjacent truss generally by between 48 to 60 inches.

While the preferred form of the present invention has been shown and described above, it should be apparent to those skilled in the art that the subject invention is not limited by the figures and that the scope of the invention includes modifications, variations and equivalents which fall within the scope of the attached claims. Moreover, it should be understood that the individual components of the invention include equivalent embodiments without departing from the spirit of this invention.

It will be understood that certain features and subcombinations are of utility and may be employed without reference to other features and subcombinations and are contemplated within the scope of the claims. Not all steps listed in the various figures need be carried out in the specific order described.

We claim:

1. A truss comprising;

a single member upper and lower chord member, each single member chord extending in generally the same longitudinal direction and in spaced apart relation;

a plurality of web members each with a first end and a second end, the web members including a crimped portion at the first end and the second end with openings disposed therein, wherein the first and second ends and openings of adjacent web members overlap;

a lower chord fastening system extending vertically through the lower chord and the overlapping openings in the first ends of adjacent web members, wherein the lower chord fastening system comprises a threaded fastener inserted through an opening in the lower chord, an opening in a web member first end, an opening in an adjacent web member second end and a hole in a nutplate before being threaded to a nut, the nutplate being comprised of a flat plate with a pair of flanges extending outwardly from two opposed sides of the flat plate, the nut plate flanges being arcuately shaped and aligned with the adjacent web member;

an upper chord fastening system extending vertically through the upper chord and through the overlapping openings of two adjacent web members, wherein the upper chord fastening system comprises a fastener inserted through an opening in the upper chord, an opening in a web member first end, an opening in an adjacent web member second end and a hole in a nut plate before being threaded to a nut, the nut plate being comprised of a flat plate with a pair of flanges extending outwardly from two opposed sides of the flat plate the nut plate flanges being arcuately shaped and aligned with the adjacent web member, the flanges bent at an angle of approximately 90 degrees to the flat plate are configured to interfere with the web members and limit rotation of the nut plate during assembly of the truss;

a washer installed on the upper and lower chord fasteners on the side of the chord opposite the nut plate, the side of the washer placed against the chord having roughened texture to prevent lateral movement of the upper and lower chord fastening systems relative to the upper and lower chords, the upper and lower chord fastening systems configured to receive the washer limited to those fastening systems adjacent a first and second longitudinal end of the truss; and wherein a plurality of lower and upper chord fastening systems are utilized across the entire length of the truss.

2. The truss of claim 1, wherein the fastener of the fastening system comprises a threaded bolt.

3. The truss of claim 1, wherein the nut of either of the upper and lower chord fastening systems contacts the nut plate when tightened in position thereby distributing the compressive force generated by the fastening system over the nut plate.

4. The truss of claim 1, further comprising a bearing plate in contact with the lower chord and disposed between a head of the fastener and the lower chord to limit movement of the lower chord fastening system.

5. The truss of claim 1, further comprising a bearing plate in contact with the upper chord and disposed between a head of the fastener and the upper chord to limit movement of the upper chord fastening system.

6. A truss comprising;

a single member upper and lower chord member, each single member extending in generally the same longitudinal direction and in spaced apart relation;

at least one web member disposed between the upper and lower chord members, the web member having a first arm and a second arm, the first and second arms being separated by a flat crimp in the web member, the first arm having a first upper end and the second arm having a second upper end;

a first fastening system extending vertically through the lower chord and through an opening in the flat crimp thereby securing the web member at the flat crimp to the lower chord;

a second fastening system extending vertically through the upper chord and the first upper end securing the first upper end to the upper chord;

a third fastening system extending vertically through the upper chord through the second upper end securing the second upper end to the upper chord, wherein the three fastening systems utilize a mechanical fastener and a nut plate, the nut plate including a flat plate and a set of oppositely disposed flanges, the flanges running substantially parallel to the first and second arms, the flanges bent at an angle of approximately 90 degrees to the flat plate are of sufficient lateral width that when the nut plate is installed the flanges contact the web members during assembly of the truss and prevent rotation of the nut plate; and a washer installed on the upper and lower chord fasteners on the side of the chord opposite the nut plate, the side of the washer placed against the chord having a roughened texture to prevent lateral movement of the upper and lower chord fastening systems relative to the upper and lower chords, the upper and lower chord fastening systems configured to receive the washer limited to those fastening systems adjacent a first and second longitudinal end of the truss.

7. The truss of claim 6 wherein the first arm and the second arm are separated at the flat crimp by an angle in the range of from 85 to 95 degrees.

8. The truss of claim 6, wherein each web member is comprised of a single continuous tubular member.

9. The truss of claim 6, wherein the lower chord fastening system comprises a threaded fastener inserted sequentially through an opening in the lower chord, and openings in the compressed portions of the first ends of the overlapping web members with a nut threaded onto the fastener.

10. The truss of claim 6, wherein the upper chord mechanical fastening system comprises a bolt passed through an opening in the upper chord, through holes in the overlapping crimped second ends of the web members and then through a hole in a nut plate before being secured in position with a nut.

11. The truss of claim 6, wherein the angle between adjacent web members at the overlapping crimped first ends on the lower chord is approximately 90 degrees.

12. The truss of claim 6, wherein the angle between adjacent web members at the overlapping crimped second ends on the upper chord is approximately 90 degrees.

13. The truss of claim 6, wherein the web members are preferably tubular members with a circular cross section.

14. The truss of claim 6, wherein a bearing plate is disposed between the bolt head and the mechanical fastening systems of the lower chord at oppositely disposed ends of the truss.

15. The truss of claim 6, wherein a bearing plate is disposed between the bolt head and the mechanical fastening systems of the upper chord at oppositely disposed ends of the truss.

16. A metal frame building system comprising a plurality of primary frames, each of the frames having a top flange, the building system comprising: a plurality of metal trusses, the metal trusses further comprising;

a single member upper and lower chord member, each single member chord extending in generally the same longitudinal direction and in spaced apart relation;

a plurality of web members with first ends of the web members secured to the lower chord and second ends of the web members secured to the upper chord, the plurality of web member first ends and second ends in an overlapping relationship with adjacent web members;

a plurality of vertically oriented mechanical fastening systems for securing the plurality of web member first ends to the lower chord and a plurality of mechanical fastening systems for securing the plurality of web member second ends to the upper chord, wherein the plurality of metal trusses are adapted to be erected upon the building system frame and are secured to the top ends of the respective primary frames, wherein the mechanical fastening systems comprise a nut, a bolt with a shank, a washer with at least one textured face, and a nut plate, the nut plate comprising a flat plate with flanges extending outwardly from two oppositely disposed sides of the nut plate and aligned with the adjacent web members, the flanges bent at an angle of approximately 90 degrees to the flat plate are of sufficient width to contact the web members upon rotation of the nut plate thereby facilitating assembly of the truss, the textured face washer installed on the upper and lower chord fasteners on the side of the chord opposite the nut plate, the textured face being placed against the chord to prevent lateral movement of the upper and lower chord fastening systems relative to the upper and lower chords, the upper and lower chord fastening systems configured to receive the washer limited to those fastening systems adjacent a first and second longitudinal end of the truss.

17. The system according to claim 16, wherein the upper and lower chords have a plurality of holes therein and the web members first and second ends have a hole there through for securing the upper and lower chords to the web members with the mechanical fastening systems.

18. The system according to claim 16, wherein the mechanical fastening system comprises the bolt inserted through the chord, the hole in the web member end and the nutplate before being threaded onto the shank and tightened against the nutplate.

* * * * *